US006314757B1

(12) United States Patent
Dray et al.

(10) Patent No.: US 6,314,757 B1
(45) Date of Patent: Nov. 13, 2001

(54) CRYOGENIC RECTIFICATION SYSTEM FOR PROCESSING ATMOSPHERIC FLUIDS

(75) Inventors: James Robert Dray, Buffalo; Theodore Fringelin Fisher, Amherst, both of NY (US)

(73) Assignee: Prakair Technology, Inc., Danbury, CT (US)

( * ) Notice: Subject to any disclaimer, the term of this patent is extended or adjusted under 35 U.S.C. 154(b) by 0 days.

(21) Appl. No.: 09/645,536

(22) Filed: Aug. 25, 2000

(51) Int. Cl.[7] ..... F25J 1/00
(52) U.S. Cl. ..... 62/648; 62/925
(58) Field of Search ..... 62/648, 925

(56) References Cited

U.S. PATENT DOCUMENTS

| | | | | |
|---|---|---|---|---|
| 4,401,448 | | 8/1983 | La Clair | 62/22 |
| 4,568,528 | | 2/1986 | Cheung | 423/262 |
| 4,574,006 | | 3/1986 | Cheung | 62/22 |
| 4,647,299 | | 3/1987 | Cheung | 62/22 |
| 4,805,412 | | 2/1989 | Colley et al. | 62/22 |
| 5,067,976 | | 11/1991 | Agrawal et al. | 62/22 |
| 5,069,698 | | 12/1991 | Cheung et al. | 62/22 |
| 5,265,429 | | 11/1993 | Dray | 62/41 |
| 5,309,719 | * | 5/1994 | Agrawal et al. | 62/925 |
| 5,313,802 | * | 5/1994 | Agrawal et al. | 62/925 |

* cited by examiner

*Primary Examiner*—Ronald Capossela
(74) *Attorney, Agent, or Firm*—Stanley Ktorides

(57) ABSTRACT

A cryogenic rectification system comprising a rare gas concentrator column for producing a liquid having an enhanced concentration of krypton and xenon, and which processes atmospheric fluids and also produces gaseous oxygen and liquid nitrogen.

10 Claims, 2 Drawing Sheets

CRYOGENIC RECTIFICATION SYSTEM FOR PROCESSING ATMOSPHERIC FLUIDS

TECHNICAL FIELD

This invention relates generally to cryogenic rectification and, more particularly, to improving the recovery of the rare gases krypton and xenon.

BACKGROUND ART

The rare gases, i.e. krypton and xenon, exist in very small concentrations in the atmosphere. Xenon is found in the ambient air in a concentration of 0.087 parts per million (ppm) and krypton is found in the ambient air in a concentration of 1.14 ppm. Because of these very small concentrations, krypton and xenon can be economically produced from only very large cryogenic air separation plants. Since the demand for these rare gases is increasing, it is desirable to be able to produce economically krypton and xenon from any size cryogenic air separation plant, and not just the very large cryogenic air separation plants.

Accordingly, it is an object of this invention to provide a system which will facilitate the recovery of krypton and xenon from smaller as well as larger cryogenic air separation plants.

Cryogenic air separation plants which produce gaseous oxygen operate most efficiently at steady state conditions. Unfortunately the demand for oxygen produced from such a facility can fluctuate between periods of high demand and periods of low demand as often as every few minutes or hours. This may require that such cryogenic air separation plants operate in an inefficient manner for much of the time although a number of methods have been identified to minimize operating and capital costs to meet variable demand.

Accordingly, it is another object of this invention to provide a system whereby cryogenic air separation plants which produce gaseous oxygen, such as for delivery to a pipeline, may operate at efficient steady state conditions during both high and low demand periods.

SUMMARY OF THE INVENTION

The above and other objects, which will become apparent to those skilled in the art upon a reading of this disclosure, are attained by the present invention, one aspect of which is:

A method for processing atmospheric fluids to produce gaseous oxygen, liquid nitrogen, and a rare gas richer liquid comprising:

(A) passing a feed liquid into a cryogenic rectification column, said feed liquid comprising oxygen, krypton and xenon, and passing the feed liquid down the cryogenic rectification column against upflowing vapor;

(B) separating the feed liquid by cryogenic rectification within the cryogenic rectification column to produce oxygen vapor and a rare gas richer liquid, and recovering oxygen vapor from the upper portion of the rectification column as product gaseous oxygen;

(C) vaporizing a portion of the rare gas richer liquid by indirect heat exchange by nitrogen vapor to generate said upflowing vapor and to produce liquid nitrogen; and (D) recovering at least some of said liquid nitrogen, and recovering rare gas richer liquid from the lower portion of the cryogenic rectification column.

Another aspect of the invention is:

Apparatus for processing atmospheric fluid to produce gaseous oxygen, liquid nitrogen, and a rare gas richer liquid comprising:

(A) a cryogenic rectification column having a bottom reboiler;

(B) means for passing a feed liquid comprising oxygen, krypton and xenon into the cryogenic rectification column;

(C) means for passing nitrogen vapor into the bottom reboiler and means for recovering liquid nitrogen from the bottom reboiler; and (D) means for recovering gaseous oxygen from the upper portion of the cryogenic rectification column, and means for recovering rare gas richer liquid from the lower portion of the cryogenic rectification column.

As used herein the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process*. The term, double column, is used to mean a higher pressure column having its upper portion in heat exchange relation with the lower portion of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein the term "indirect heat exchange" means the bringing of two fluids into heat exchange relation without any physical contact or intermixing of the fluids with each other.

As used herein the term "bottom reboiler" means a heat exchange device that generates column upflow vapor from column liquid. A bottom reboiler may be inside or outside the column.

As used herein the terms "subcooling" and "subcooler" mean respectively method and apparatus for cooling a liquid to be at a temperature lower than that liquid's saturation temperature for the existing pressure.

As used herein the term "top condenser" means a heat exchange device that generates column downflow liquid from column vapor. A top condenser may be inside or outside the column.

As used herein the terms "upper portion" and "lower portion" mean those sections of a column respectively above and below the mid point of the column.

DETAILED DESCRIPTION

The invention enables the concentration of krypton and xenon produced in any size cryogenic air separation plant into a liquid mixture for further processing, while simultaneously enabling the cryogenic air separation plant(s) to operate at efficient steady state conditions throughout high and low demand periods.

Figure 1:
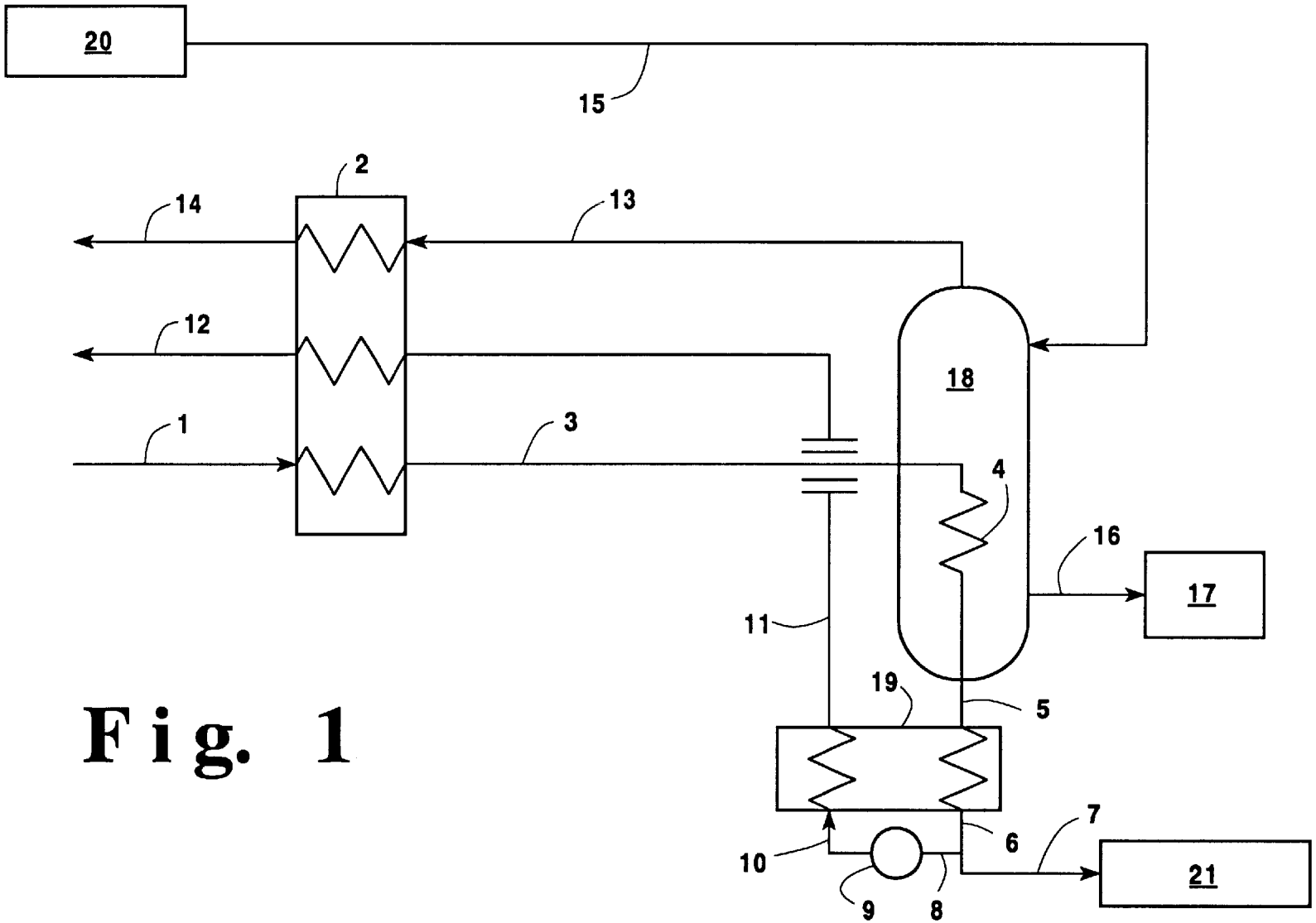
FIG. 1 is a schematic representation of one embodiment of the cryogenic processing system of this invention.

The invention will be described in greater detail with reference to the Drawings. Referring now to FIG. 1, feed liquid 15 is passed into the upper portion of cryogenic rectification column 18. Feed liquid 15 comprises oxygen, krypton and xenon.

Generally the krypton concentration of feed liquid 15 is within the range of from 10 to 35 ppm, and the xenon concentration of feed liquid 15 is within the range of from 1 to 20 ppm, with the remainder being essentially all oxygen. Feed liquid 15 is produced in a cryogenic air separation plant and is typically taken from the sump of the lower pressure column of a double column cryogenic air separation plant. One or more cryogenic air separation plants will supply the feed liquid, such as to a storage facility 20 comprising one or more cryogenic tanks which is used as a reservoir to supply feed liquid to cryogenic rectification column 18. The feed liquid from the cryogenic air separation plants can be fed directly to cryogenic rectification column 18, or to storage facility 20 or to both simultaneously. The feed liquid can be passed to column 18 from both the storage facility and from one or more of the cryogenic air separation plants. The feed liquid may be supplied from one or more cryogenic air separation plants during periods of low gaseous oxygen demand thereby relieving the cryogenic air separation plants from operating inefficiently during the low demand period.

Cryogenic rectification column 18 is operating at a pressure generally within the range of from 15 to 190 pounds per square inch absolute (psia). The feed liquid flows down the column countercurrently co upflowing vapor and undergoes cryogenic rectification within the column. The majority of the feed liquid 15 entering column 18 is vaporized and this vaporized portion, owing to the relative volatilities of oxygen, krypton and xenon, contains very little krypton and xenon. This results in the production of relatively rare gas free oxygen vapor in the upper portion of column 18, and in the production of rare gas richer liquid in the lower portion of column 18. The oxygen vapor is withdrawn from the upper portion of column 18 in stream 13, warmed by passage through heat exchanger 2 and recovered as product gaseous oxygen in stream 14, typically having an oxygen concentration within the range of from 90 to 99.9 mole percent. The oxygen product may be passed to a demand source such as a pipeline during a peak demand period thus relieving the cryogenic air separation plant or plants serving that demand source from operating in an efficient higher than steady state mode to meet the peak demand.

Gaseous nitrogen 1, generally having a pressure within the range of from 60 to 450 psia and a nitrogen concentration of at least 99.9 mole percent, and taken from a cryogenic air separation plant, is cooled in heat exchanger 2 by indirect heat exchange with return streams and the resulting cooled gaseous nitrogen in stream 3 is passed into bottom reboiler 4 wherein it is condensed by indirect heat exchange with rare gas richer liquid, thereby serving to vaporize a portion of =the rare gas richer liquid to generate the upflowing vapor for the operation of cryogenic rectification column 18. Remaining rare gas richer liquid in the sump of column 18, which has now been even further concentrated in krypton and xenon, is withdrawn from the lower portion of column 18 in stream 16 and recovered. In the embodiment of the invention illustrated in FIG. 1 stream 16 is passed into storage tank 17. Typically rare gas richer liquid in stream 16 has a krypton concentration within the range of from 500 to 5000 ppm and a xenon concentration within the range of from 50 to 500 ppm, with the remainder being mostly oxygen. The rare gas richer liquid may then be further processed to produce commercial grade krypton and xenon. Since the rare gas concentration function of this invention operates independently of the direct operation of any individual cryogenic air separation plant, feed liquid produced in any size plant may be used as part of the feed 15 into column 18 thereby enabling the efficient recovery of the rare gases from liquid produced in small and medium size plants as well as the large plants.

Liquid nitrogen produced in bottom reboiler 4 is withdrawn from bottom reboiler 4 in stream 5 and recovered. FIG. 1 illustrates a preferred embodiment of the invention wherein the liquid nitrogen is subcooled prior to recovery. Liquid nitrogen in stream is subcooled in subcooler 19 and withdrawn as subcooled liquid nitrogen in stream 6, the majority of which is passed in stream 7 to, for example, liquid nitrogen storage tank 21. A portion 8 of stream 6, generally comprising from 15 to 35 percent of stream 6, is throttled to a low pressure, generally within the range of from 15 to 20 psia, by passage through valve 9, and resulting stream 10 is fed to subcooler 19 to provide the refrigeration required to subcool the liquid nitrogen in stream 5. Resulting warmed nitrogen in stream 11 is further warmed by passage through heat exchanger 2 and recovered as gaseous nitrogen stream 12.

The production of liquid nitrogen by the use of the invention provides an added benefit. By producing liquid nitrogen as a byproduct of operating the rare gas concentrator system of this invention, liquid nitrogen need not be produced in the cryogenic air separation plant or plants which supply the nitrogen and the feed liquid for the operation of the invention. This improves the recovery of oxygen and, if desired, argon from such cryogenic air separation plant(s).

Table 1 presents the results of one example of the invention carried out in accord with the embodiment of the invention illustrated in FIG. 1. In Table 1 the stream numbers correspond to those shown in FIG. 1. This example is presented for illustrative purposes and is not intended to be limiting.

TABLE 1

| Stream Number | Flow lb mol | Pressure, psia | Temperature, K. | Composition O2, % | N2, % | Kr, ppm | Xe, ppm | Hc, ppm | Other, % |
|---|---|---|---|---|---|---|---|---|---|
| 1 | 1290 | 90 | 300 | 0 | 100 | 0 | 0 | 0 | 0 |
| 3 | 1290 | 90 | 110 | 0 | 100 | 0 | 0 | 0 | 0 |
| 5 | 1290 | 90 | 96 | 0 | 100 | 0 | 0 | 0 | 0 |
| 6 | 1290 | 90 | 80 | 0 | 100 | 0 | 0 | 0 | 0 |
| 7 | 1060 | 90 | 80 | 0 | 100 | 0 | 0 | 0 | 0 |
| 8 | 230 | 90 | 80 | 0 | 100 | 0 | 0 | 0 | 0 |
| 10 | 230 | 18 | 79 | 0 | 100 | 0 | 0 | 0 | 0 |
| 11 | 230 | 17 | 79 | 0 | 100 | 0 | 0 | 0 | 0 |
| 12 | 230 | 16 | 297 | 0 | 100 | 0 | 0 | 0 | 0 |
| 13 | 987 | 22 | 94 | 99.7 | 0 | 1.6 | 0.01 | 5.5 | 0.3 |
| 14 | 987 | 21 | 297 | 99.7 | 0 | 1.6 | 0.01 | 5.5 | 0.3 |
| 15 | 1000 | 23 | 94.5 | 99.7 | 0 | 12.4 | 1.17 | 17.4 | 0.3 |
| 16 | 13 | 23 | 94.5 | 99.8 | 0 | 830 | 89 | 924 | 157 ppm |

Figure 2:
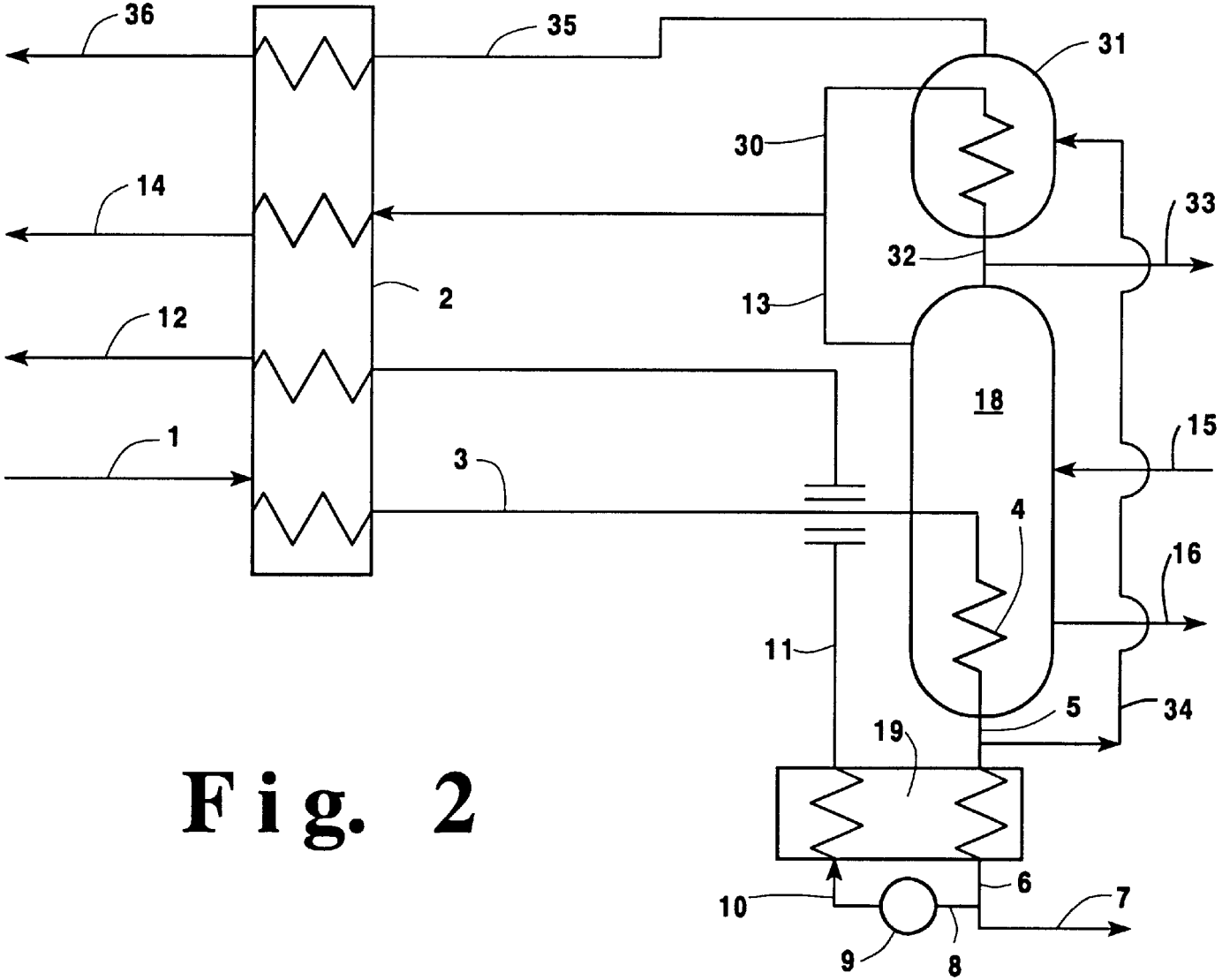
FIG. 2 is a schematic representation of another embodiment of the cryogenic processing system of this invention

FIG. 2 illustrates another embodiment of the cryogenic atmospheric fluid processing system of this invention. The numerals in FIG. 2 correspond to those of FIG. 1 for the common elements and these common elements will not be described again in detail.

Referring now to FIG. 2, a portion 30 of gaseous oxygen stream 13 is passed into top condenser 31 and condensed. Resulting condensed oxygen 32 is passed down column 18 as reflux liquid to enhance the rectification within the column. If desired, a portion 33 of the condensed oxygen may be recovered as product liquid oxygen which is essentially devoid of either of the rare gases. A portion 34 of the liquid nitrogen from bottom reboiler 4 is passed into top condenser 31 wherein it is vaporized to effect the aforesaid condensation of gaseous oxygen 30. Resulting gaseous nitrogen 35 is withdrawn from top condenser 31, warmed by passage through heat exchanger 2 and recovered as gaseous nitrogen product in stream 36 having a higher pressure than the gaseous nitrogen product in stream 12.

The invention combines a centralized rare gases concentrating system with equipment that is used to meet variable oxygen pipeline demand. Conventional systems address recovering rare gas from individual air separation units and incorporate systems that are integrated into the operation of each individual air separation unit. They are aimed primarily at rare gases concentrating systems integrated with individual plants and methods of meeting variable pipeline demands, which do not have provisions or considerations for rare gases recovery. The invention aims to provide rare gas and minimize disruptions to the existing air separation facilities and does this by utilizing a rare gas system that operates independently from the operation of the air separation unit greatly enhancing the overall flexibility and operation of both the air separation unit and the rare gas concentrator unit. This allows for the processing of liquid from various facilities to recover the rare gas with no adverse impact of the process or rare gas recovery. If a conventional system were to receive liquid oxygen addition, then the operation of the air separation unit would have to be modified in order to handle the excess refrigeration caused by liquid oxygen addition. The resulting changes usually result in loss of rare gas recovery and would also result in a decrease in argon recovery in the air separation facility.

Now by the use of this invention one can not only effectively produce rare gas richer liquid for further processing to produce commercial grade krypton and xenon, but also can use this system to smooth out production from cryogenic air separation plants during periods of variable demand, and, in addition, can economically recover krypton and xenon from the feed air processed in small and medium size cryogenic air separation plants.

Although the invention has been described in detail with reference to certain preferred embodiments, those skilled in the art will recognize that there are other embodiments of the invention within the spirit and the scope of the claims.

What is claimed is:

1. A method for processing atmospheric fluids to produce gaseous oxygen, liquid nitrogen, and a rare gas richer liquid comprising:

(A) passing a feed liquid into a cryogenic rectification column, said feed liquid comprising oxygen, krypton and xenon, and passing the feed liquid down the cryogenic rectification column against upflowing vapor;

(B) separating the feed liquid by cryogenic rectification within the cryogenic rectification column to produce oxygen vapor and a rare gas richer liquid, and recovering oxygen vapor from the upper portion of the rectification column as product gaseous oxygen;

(C) vaporizing a portion of the rare gas richer liquid by indirect heat exchange by nitrogen vapor to generate said upflowing vapor and to produce liquid nitrogen; and (D) recovering at least some of said liquid nitrogen, and recovering rare gas richer liquid from the lower portion of the cryogenic rectification column.

2. The method of claim 1 wherein the liquid nitrogen is subcooled prior to recovery.

3. The method of claim 2 wherein a portion of the liquid nitrogen is reduced in pressure to generate refrigeration and this refrigeration bearing portion is employed to subcool the liquid nitrogen.

4. The method of claim 1 wherein a portion of the oxygen vapor is condensed to produce liquid oxygen and a portion of the liquid oxygen is recovered.

5. The method of claim 4 wherein the oxygen vapor is condensed by indirect heat exchange with liquid nitrogen.

6. Apparatus for processing atmospheric fluid to produce gaseous oxygen, liquid nitrogen, and a rare gas richer liquid comprising:

(A) a cryogenic rectification column having a bottom reboiler;

(B) means for passing a feed liquid comprising oxygen, krypton and xenon into the cryogenic rectification column;

(C) means for passing nitrogen vapor into the bottom reboiler and means for recovering liquid nitrogen from the bottom reboiler; and (D) means for recovering gaseous oxygen from the upper portion of the cryogenic rectification column, and means for recovering rare gas richer liquid from the lower portion of the cryogenic rectification column.

7. The apparatus of claim 6 further comprising a subcooler wherein the means for recovering liquid nitrogen from the bottom reboiler includes the subcooler.

8. The apparatus of claim 7 further comprising a throttle valve, means for passing fluid from the subcooler to the throttle valve, and means for passing fluid from the throttle valve to the subcooler.

9. The apparatus of claim 6 further comprising a top condenser, means for passing fluid from the upper portion of the cryogenic rectification column into the top condenser, and means for recovering fluid from the top condenser.

10. The apparatus of claim 9 further comprising means for passing fluid from the bottom reboiler to the top condenser.

* * * * *

UNITED STATES PATENT AND TRADEMARK OFFICE

CERTIFICATE OF CORRECTION

PATENT NO. : 6,314,757 B1
DATED : November 13, 2001
INVENTOR(S) : Dray et al.

It is certified that error appears in the above-identified patent and that said Letters Patent is hereby corrected as shown below:

Title page,
Item [73], Assignee delete "Prakair" and insert therefor -- Praxair --.

Column 3,
Line 67, delete "co" and insert therefor -- to --.

Column 4,
Line 28, delete "=the" and insert therefor -- the --.
Line 55, between "stream" and "is" insert -- 5 --.

Signed and Sealed this

Twenty-third Day of April, 2002

*Attest:*

*Attesting Officer*

JAMES E. ROGAN
*Director of the United States Patent and Trademark Office*